US006497184B1

(12) United States Patent
Whitesitt

(10) Patent No.: US 6,497,184 B1
(45) Date of Patent: Dec. 24, 2002

(54) ARTICULATED MODULAR TABLE

(76) Inventor: W. Scott Whitesitt, 6194 W. Sturgeon Rd., Rathdrum, ID (US) 83858

( * ) Notice: Subject to any disclaimer, the term of this patent is extended or adjusted under 35 U.S.C. 154(b) by 0 days.

(21) Appl. No.: 09/789,334

(22) Filed: Feb. 20, 2001

(51) Int. Cl.[7] ..... A47B 57/00
(52) U.S. Cl. ..... 108/64; 108/65; 108/66
(58) Field of Search ..... 108/64, 65, 66, 108/84, 95

(56) References Cited

U.S. PATENT DOCUMENTS

| | | | | | |
|---|---|---|---|---|---|
| 2,705,179 | A | | 3/1955 | Hodgin | 311/4 |
| 4,542,936 | A | * | 9/1985 | Gafken | 108/95 X |
| 5,035,186 | A | | 7/1991 | Uredat | 108/159 |
| 5,363,772 | A | * | 11/1994 | Adamidis | 108/96 X |
| 5,425,313 | A | | 6/1995 | Rowan | 108/65 |
| 5,438,937 | A | | 8/1995 | Ball | 108/64 |
| 5,458,070 | A | | 10/1995 | Gamba | 108/66 |
| 5,568,775 | A | | 10/1996 | Rizzi | 108/64 |
| 5,704,298 | A | * | 1/1998 | Corpuz, Jr. et al. | 108/64 X |
| 5,842,425 | A | * | 12/1998 | Van Der AA | 108/64 |
| 5,848,497 | A | | 12/1998 | Henderson | 52/36.1 |
| 5,934,203 | A | * | 8/1999 | Glass | 108/50.02 X |
| 5,943,966 | A | | 8/1999 | Machado | 108/64 |
| 5,967,058 | A | | 10/1999 | Ambrose | 108/64 |
| 6,161,487 | A | * | 12/2000 | Chang | 108/64 X |
| 6,182,580 | B1 | | 2/2001 | Barret | 108/64 |

FOREIGN PATENT DOCUMENTS

| | | |
|---|---|---|
| EP | 0852121 | 7/1998 |

OTHER PUBLICATIONS

"Contract" Magazine Jul. 2000 Pg.: Inside Back Cover Designed By: J. W. Beam "Scissors"table.

* cited by examiner

*Primary Examiner*—Jose V. Chen

(57) ABSTRACT

A pivoting structure for joining and supporting two co-planar surfaces (52) that pivot independently around a fixed point between the tables at one end on a pivot assembly (35). The co-planar surfaces are supported at the opposite end by a support leg (54) that provides rotation quickly and easily by one person by means of a pivoting wheel (62). An array of positions can be fixed by means of a wheel brake lever (60). The pivot assembly is supported with a pivot support (28) and a base (22). The pivoting structure's geometry is such that multiple similar structures can be configured modularly to provide an even greater variety of practical positions.

6 Claims, 8 Drawing Sheets

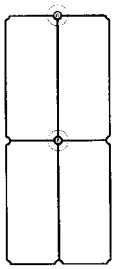
FIG. 5-A
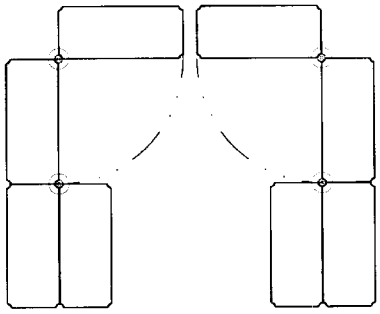
FIG. 5-B
FIG. 5-C
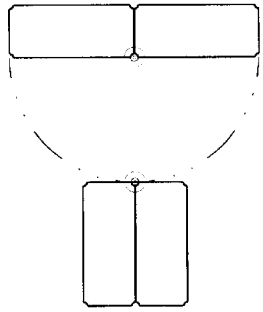
FIG. 5-D
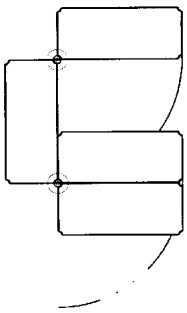
FIG. 5-E
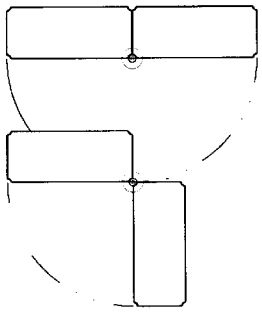
FIG. 5-F
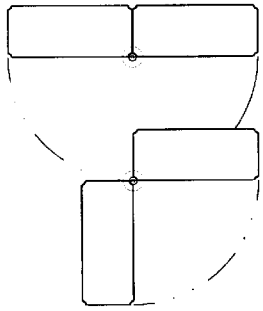
FIG. 5-G
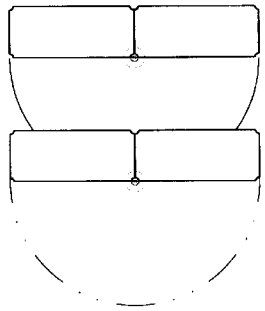
FIG. 5-H
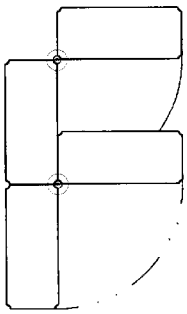
FIG. 5-I
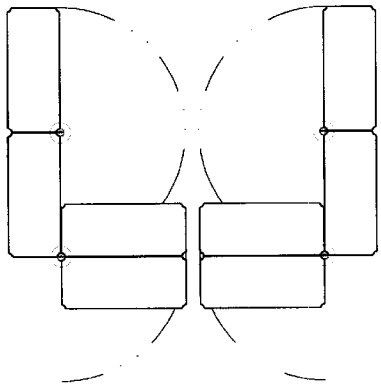
FIG. 5-J
FIG. 5-K
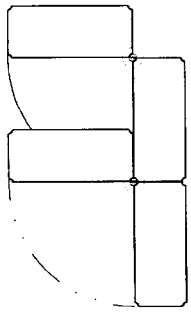
FIG. 5-L

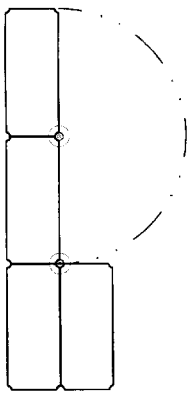
FIG. 5-M
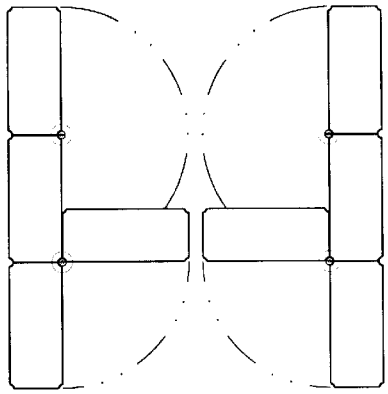
FIG. 5-N
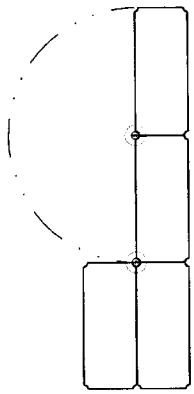
FIG. 5-O
FIG. 5-P
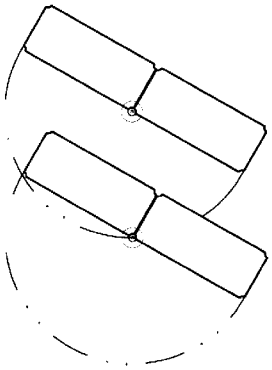
FIG. 5-Q
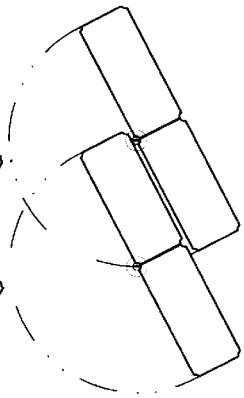
FIG. 5-R
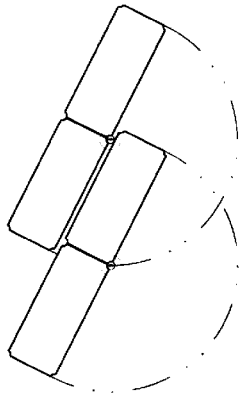
FIG. 5-S
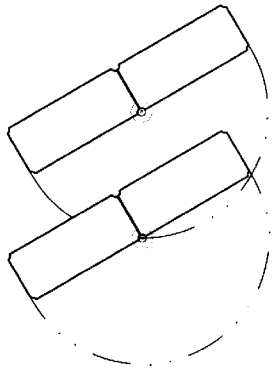
FIG. 5-T
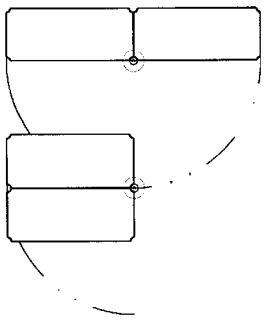
FIG. 5-U
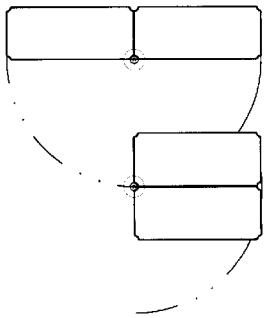
FIG. 5-V
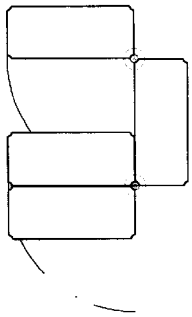
FIG. 5-W
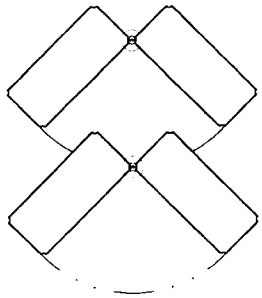
FIG. 5-X

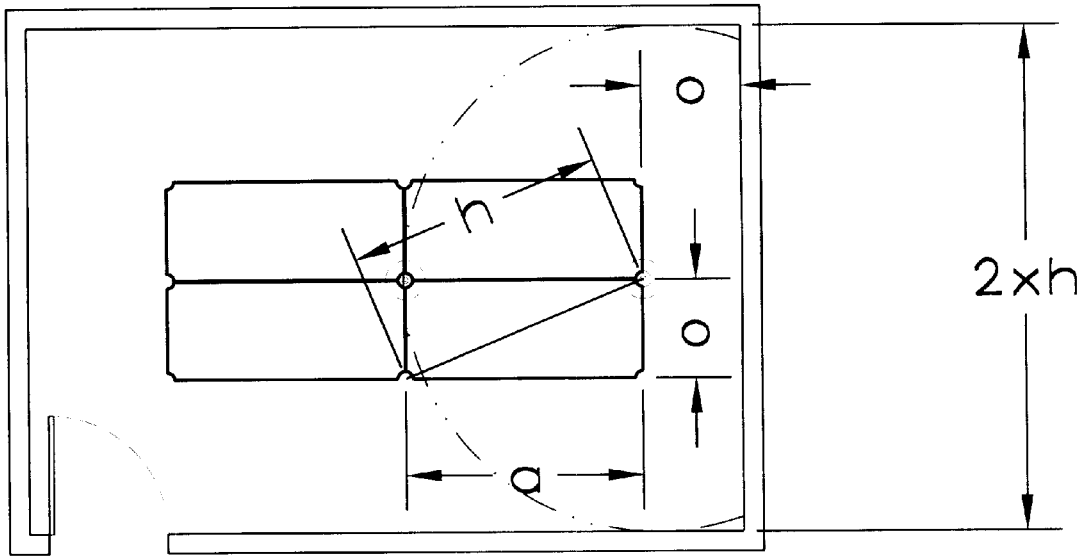
FIG. 6
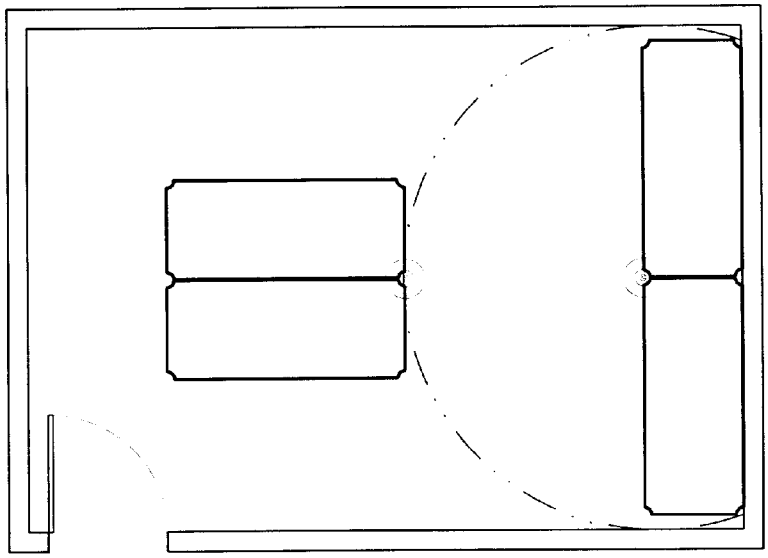
FIG. 6-A

ARTICULATED MODULAR TABLE

CROSS REFERENCE TO RELATED APPLICATIONS

Not applicable.

BACKGROUND—FIELD OF INVENTION

This invention relates to furnishings in particular a pivoting structure for joining and articulating two co-planar surfaces of adjacent tables that can be arranged in any array of positions and modular configurations.

BACKGROUND—DESCRIPTION OF PRIOR ART

Offices, educational facilities, and homes regularly furnish their spaces with tables. These work surfaces are often arranged in different configurations to complement different functions.

Arrangement of alternate configurations is time consuming, awkward and often mandates the involvement of two or more people. Replicating various positions is difficult without positioning marks or measuring. In addition, long rectilinear conference tables loose some functionality when presentations are made due to the linear arrangement of the audience to the presenter or other communication media.

Furthermore, when furnishings become dated and tables are replaced, it is often necessary to replace the entire table structure rather than just the work surface.

Modular table systems are generally well known in the art and typically comprise multiple duplicate or similar tables, which can be arranged and locked into different configurations. To a lesser extent articulating tables have been introduced in an attempt to solve some of the above mentioned problems. In today' business and teaching climate the popularity of collaborative problem solving creates the need for work surfaces that are flexible and can be rearranged very quickly. Prior art modular systems have tended to be difficult to reconfigure and often involve lifting, pulling, unlatching, banging and reinserting major components.

Prior art articulating systems have similar drawbacks and due to their curvilinear and unusual shapes are limited in configuration by the rectilinear rooms that they most often occupy.

It is known, for example, from the prior art referred to as the "scissors table", designed by J. Wade Beam (July 2000 issue of *Contract,* inside back cover), that it would take a conference room that was twice as wide as the length of the table to position the table parallel to a presentation at either end of the table. In addition the large drum of the pivoting mechanism and shape of the table makes it unsuitable for modular and rectangular configurations. Its pivoting mechanism serves only as a guide necessitating plurality of table legs for support and stability, which encumbers seating from both sides of each table surface.

SUMMARY

This invention comprises a fixed articulating support for joining two co-planar surfaces of adjacent tables that can be arranged in an array of positions by means of two additional wheeled supports and can be configured with replicas of itself modularly.

OBJECTS AND ADVANTAGES

Several objects and advantages are:

(a) to provide an articulating arrangement of two coplanar work surfaces of adjacent tables that can be moved into multiple positions;

(b) to provide movement into multiple positions easily by one person without lifting, pulling, banging, unlatching or reinserting major components;

(c) to provide a geometric arrangement that maximizes the use of space within a rectilinear room;

(d) to provide exact positioning each time the invention is reconfigured;

(e) to provide movement of each table surface independent of the other;

(f) to provide a multitude of alternate configurations through the modular addition of replicated units;

(g) to provide a support structure that allows a variety of table surfaces to be interchanged;

(h) to provide a wiring raceway through the pivot support for data, phone, or electrical devices.

Further objects and advantages will become apparent from a consideration of the ensuing description and drawings.

DRAWING FIGURES

FIGS. 5-A to 5-X show aerial views of two tables and twenty-four of the many possible positions the tables can be configured when used modularly.

FIGS. 6 and 6-A show plan views demonstrating my inventions judicious use of space in a rectilinear room.

Figure 7:
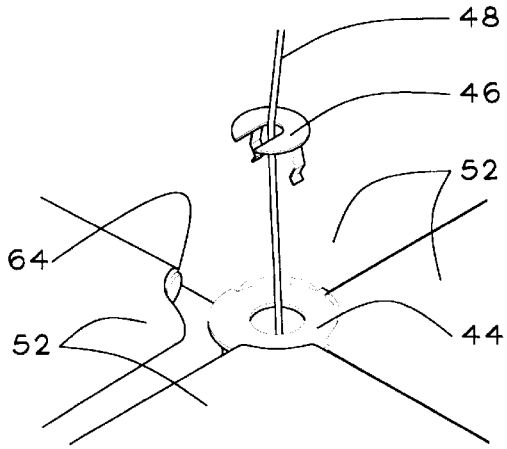

FIG. 7 shows an isometric view of a center alignment disk in relation to the table surfaces.

Figure 8:
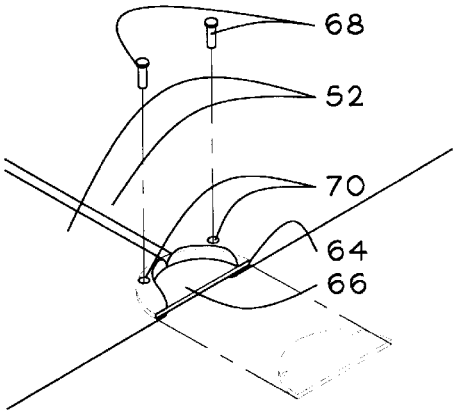

FIG. 8 shows an isometric view of an outer alignment disk in relation to the table surfaces.

Figure 9:
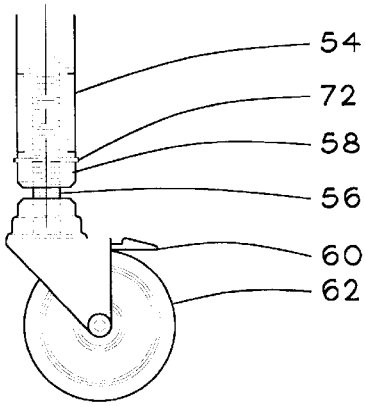

FIG. 9 shows an elevation of the wheel, brake, and height adjustment mechanism.

Figure 10:
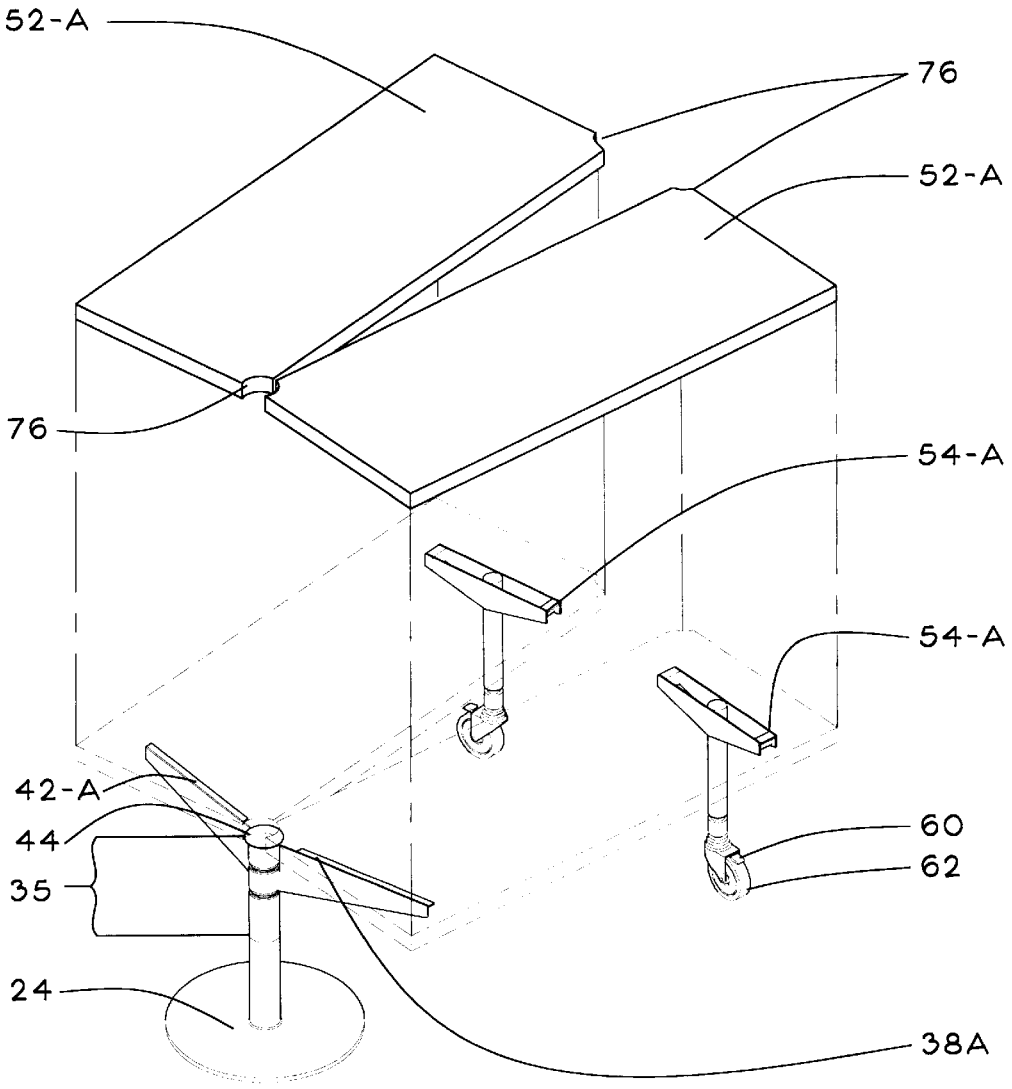

FIG. 10 shows an isometric view of an additional embodiment of my articulating table eliminating the carriage and using the table surface for the carriage structure.

REFERENCE NUMERALS IN DRAWINGS

| | | | |
|---|---|---|---|
| 20 | anchor bolt | 22 | base |
| 24 | alternate base | 26 | wiring void |
| 28 | pivot support | 30 | spindle |
| 31 | groove | 32 | bearing retaining ring |
| 34 | bearing | 35 | pivot assembly |
| 36 | lower pivot hub | 38 | lower pivot arm |
| 38-A | lower pivot arm with tab | 40 | upper pivot hub |
| 42 | upper pivot arm | 42-A | upper pivot arm with tab |
| 44 | center alignment disk | 46 | wiring escutcheon |
| 48 | wiring | 50 | carriage |

-continued

| REFERENCE NUMERALS IN DRAWINGS | | | |
|---|---|---|---|
| 52 | table surface | 52-A | alternate table surface |
| 54 | support leg | 54-A | support leg with tab |
| 56 | height adjustment screw | 58 | adjustment nut |
| 60 | wheel brake lever | 62 | pivoting wheel |
| 64 | alignment slot | 66 | outer alignment disk |
| 68 | alignment pin | 70 | alignment holes |
| 72 | washer | 76 | notch |

Figure 1:
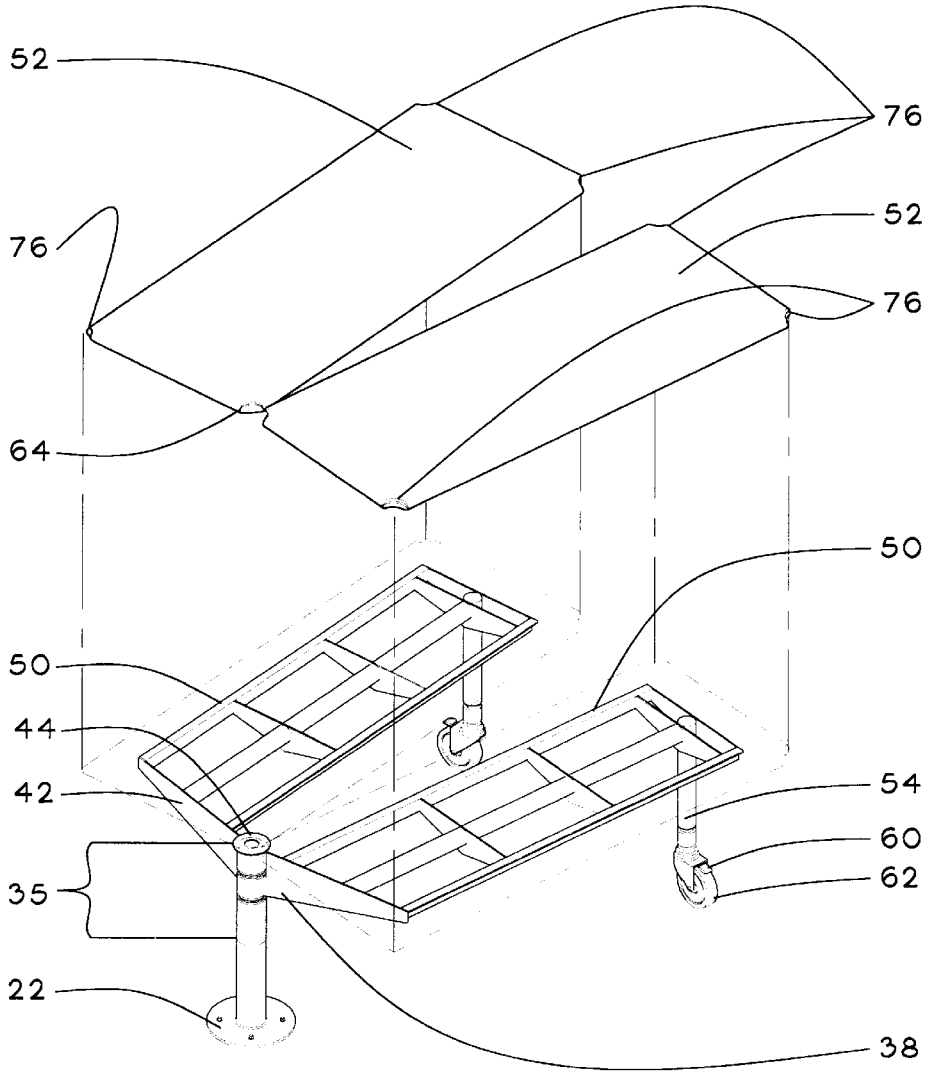
FIG. 1 shows an isometric view of a basic version of my articulating modular table.

FIG. 1 shows an isometric view of the preferred embodiment of my articulated modular table. The table comprises two co-planar table surfaces 52. Each table surface is connected to a carriage 50. Each carriage is supported with a support leg 54 having a pivoting wheel 62 with a brake lever 60. The carriages are supported on their opposite ends by an upper pivot arm 42 and a lower pivot arm 38. The pivot arms are connected to a pivot assembly 35. The pivot assembly is connected to a pivot support 28. The pivot support is connected to a base 22. The base is connected with anchor bolts 20 to a floor substrate.

Figure 2:
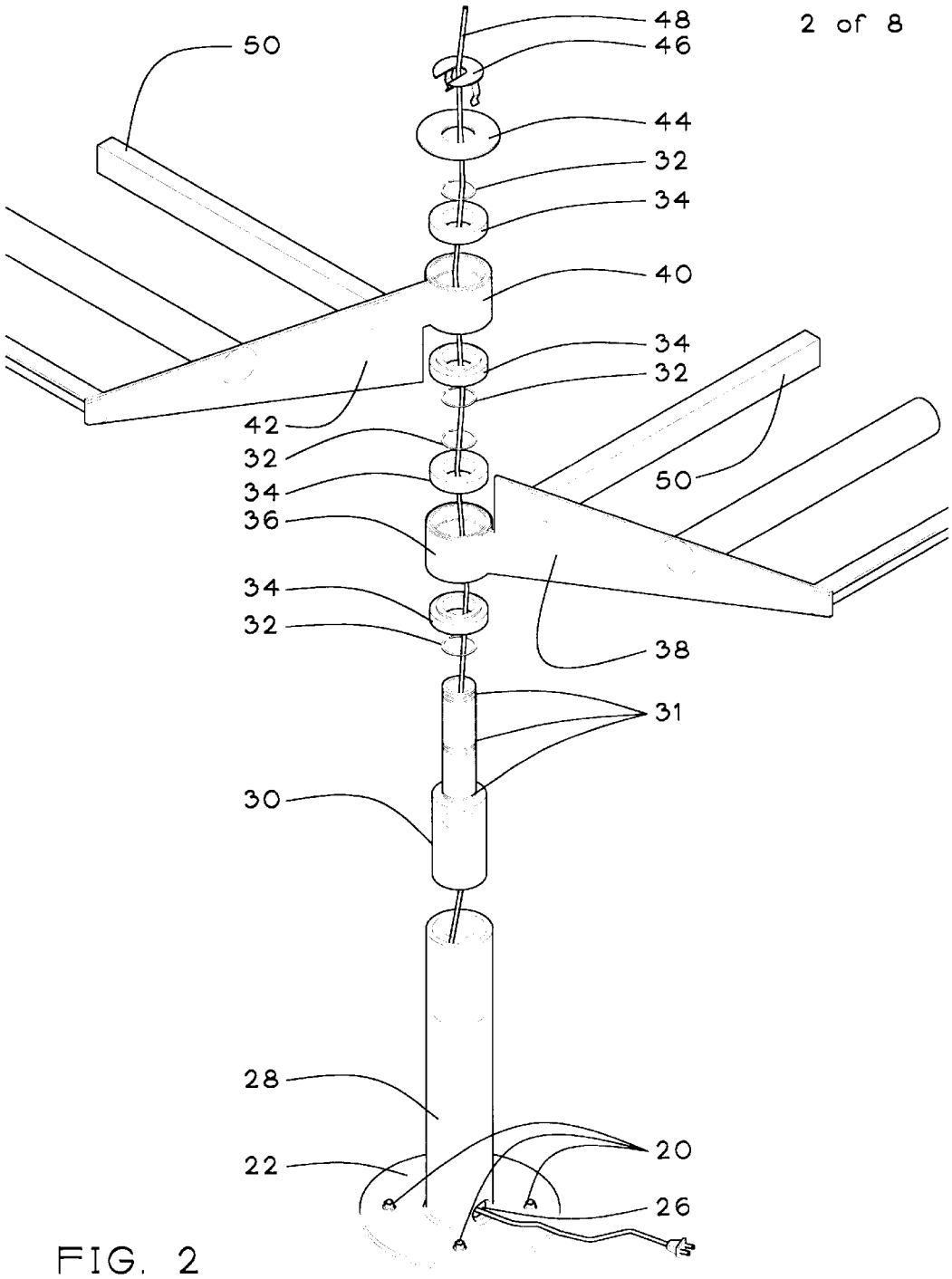
FIG. 2 shows an exploded view of the pivot support and pivoting mechanism.

FIG. 2 is an exploded view of the pivot support and pivot assembly. The pivot support 28 has a wiring void 26 that allows electrical wiring 48 to penetrate the pivot support 28 and the pivot assembly 35 shown in FIG. 1. The pivot assembly comprises a spindle 30 encircled by a lower pivot hub 36 and an upper pivot hub 40. The lower half of the spindle 30 fits inside and is connected to the pivot support 28 and has an outside diameter complimentary to the inside diameter of the pivot support. The pivot hubs 36 and 40 have a top and bottom bearing 34. The inside of the bearing fits around the spindle 30 and is retained by an upper and lower bearing retaining ring 32 that fastens into a groove 31 on the spindle 30. The inside of the bearing 34 is attached to the spindle 30 and the outside of the bearing 34 is attached to the pivot hubs 36 and 40. Attached to the top of the spindle 30 is a center alignment disk 44. Inserted in the center alignment disk 44 is a wiring escutcheon 46.

Figure 3:
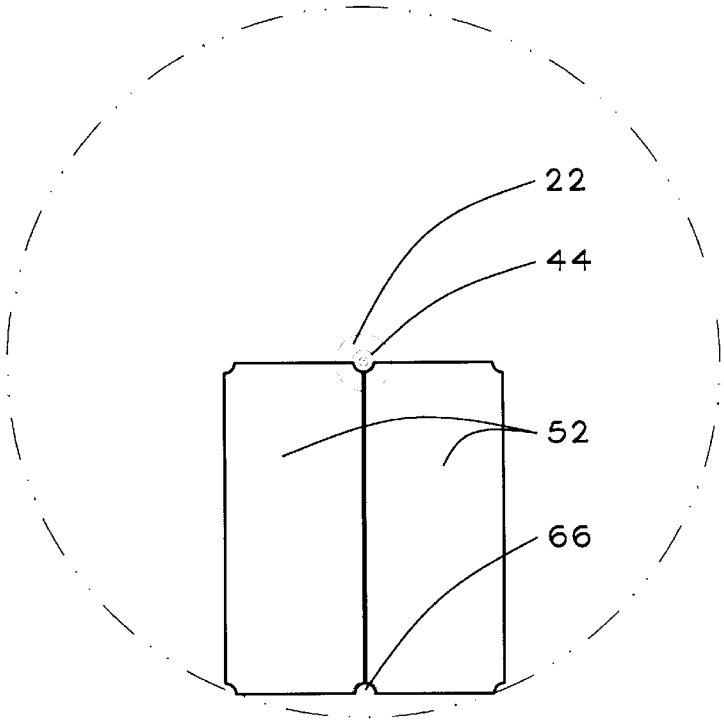
FIG. 3 shows an aerial view of the table in a folded position and the possible range of movement around the pivot support.
Figure 4:
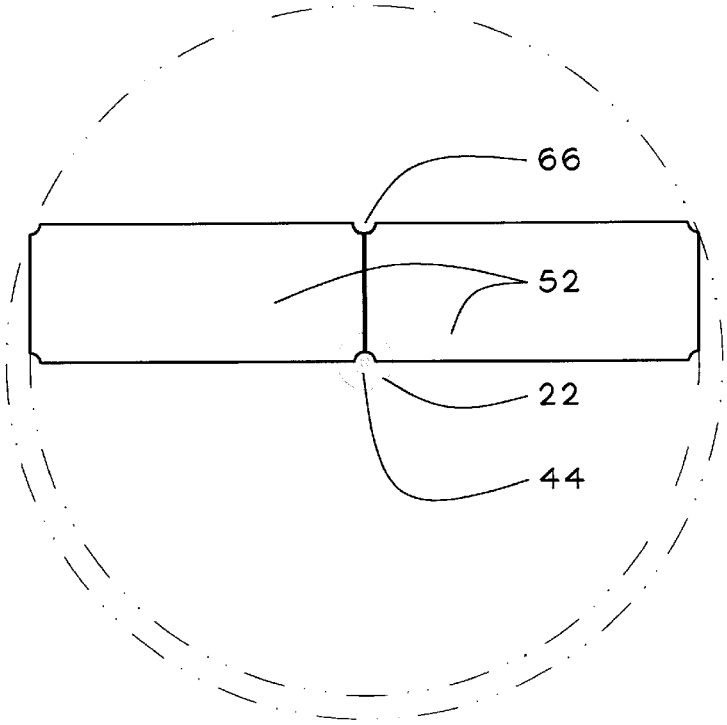
FIG. 4 shows an aerial view of table in its extended position and the possible range of movement around the pivot support.

FIG. 3 and FIG. 4 show aerial views of the articulating tables and demonstrate two different positions for an outer alignment disk 66. FIG. 8 shows an isometric view of the alignment disk inserted into a notch 76 having an alignment slot 64 in the table surface 52. Each side of the alignment disk is locked to the table surface by means of an alignment pin 68 that fits an alignment hole 70 that is aligned through each table surface and each side of the outer alignment disk 66. FIG. 7 shows an isometric view of the center alignment disk 44 and its relationship to the table surfaces 52 and the alignment slots 64.

FIG. 9 is an elevation of the relationship between pivoting wheel 62 and the support leg 54. The pivoting wheel 62 is attached to the bottom of a height adjustment screw 56 that fits into the support leg 54. A washer 72 fits between the support leg and an adjustment nut 58.

Operation—FIGS. 1, 2, 3, 4, (5-A)–(5-X), 7, 8, and 9

The manner of using my articulated modular table is understood best by viewing FIGS. 1, 2, and 3. The user unlocks the wheel by elevating the wheel brake lever 60 either by hand or foot and places ones hand on the table edge. A slight push will independently rotate either table surface up to 90 degrees to the other surface, as shown in FIG. 3 and FIG. 4. In any array of radial positions up to 90 degrees of each table surface, both surfaces can rotate together 360 degrees. Once a desired position is attained the user locks the pivoting wheel 62 by depressing the wheel brake lever 60 either by hand or by foot to secure the position.

When used singularly or modularly the table surface edges can be aligned and locked co-planar to each other when in longitudinal or lateral position, as shown in FIGS. 3 and 4, and in modular positions shown in FIGS. (5-A)–(5-W) by means of the outer alignment disk 66. The outer alignment disk's purpose is to align and position the table surfaces co-planar to each other compensating for irregular or un-level floor surfaces. In FIG. 8 the outer alignment disk 66 is inserted by hand into the alignment slot 64 and locked into position by inserting the alignment pins 68 through the table surface 52 and the disk alignment holes 70. The alignment pins 68 are held in place by gravity, thus removal of the alignment disk involves pushing up on the bottom of each alignment pin 68, pulling them out, and removing the outer alignment disk 66.

The pivoting wheel 62 shown in FIG. 1 and FIG. 9 pivots 360 degrees and is common in the art, thus enabling rotation of the table surfaces clockwise or counter clockwise. To account for floor irregularities or non-level conditions the pivoting wheel is connected to the height adjustment screw 56. The table surfaces can be thus aligned co-planar to each other by means of rotating the adjustment nut 58 by hand. The washer 72 provides a smooth bearing surface between support leg 54 and adjustment nut 58. Height adjustment screws for pivoting wheels are considered common in the art.

In FIG. 1 the table surfaces 52 provide a horizontal coplanar utility surface for a variety of functions. The table surface is regular with the exception of quarter circle notches 76 in each corner. As explained above, the notches 76 provide an area to insert the outer alignment disks 66 and in a similar way the notches 76 provide alignment around the center alignment disk 44 shown in FIG. 7. In addition FIG. 7 shows that the notches 76 provide an exit for wiring 48. The wiring escutcheon 46 is inserted in the center void of the center alignment disk 44 to provide an aesthetically pleasing cap and manage the direction of the exiting wiring. Wiring escutcheons of this type are common to the art. In a modular configuration the notches provide a means by which a similar table assembly can abut an adjacent pivot assembly FIGS. 5-A and 7. Below the center alignment disk 44 FIG. 1 shows the pivot assembly 35. The pivot assembly enables the upper and lower pivot arms 42 and 38 to rotate around a fixed location at one end of the inside corner of the two table surfaces. The upper and lower pivot arms provide a means of support for one end of each table carriage 50. The upper pivot arm 42 is notched in a manner opposite to lower pivot arm 38, providing a means for the pivot arms to be attached to the upper and lower pivot hubs 40 and 36 in adjacent locations vertically and at the same time provide a common horizontal elevation for the carriage attachment. The table carriage 50 provides a support and attachment plane for the table surfaces 52. The pivot assembly 35 comprises an upper and a lower pivot hub 40 and 36 shown in FIG. 2. Each of the pivot hubs contains two bearings 34. Each bearing has an outer surface attached by friction to the pivot hub and an inner surface attached to the upper half of the spindle 30. The hubs are retained in position on the spindle by bearing retaining rings 32 that fit into grooves 31 on the spindle. This assembly provides a means of rotating the lower and upper pivot arms 38 and 42 independently of each other. The lower half of the spindle 30 fits into the pivot support 28 having an outside dimension complimentary to the inside dimension of the pivot support. The pivot support is secured to the base 22 providing the means of support at one end of both table surfaces. The pivot support has a wiring void 26 providing an entrance for electrical wiring

48. The base is secured to the floor surface by anchor bolts 20 providing a means of stabilization for one end both table surfaces.

In FIGS. 6 and 6-A the operation of my invention is demonstrated in a modular arrangement of two units in a minimal spatial constraint. Where the length of a table surface is a, and the width of a table surface is o, the required room width to fully extend a pair of tables would be two times the hypotenuse h of right angle a-o. In addition the table surfaces can pivot directly against a perpendicular planar wall providing the distance from the wall is equal to the width of the table surface o.

FIG. 10—-Additional Embodiment

An additional embodiment is shown in FIG. 10. It differs from the preferred embodiment in five areas.

1. The carriage 50 of FIG. 1 of the preferred embodiment is eliminated using the table surface 52-A as the structural carriage.
2. The pivot arms 42-A and 38-A are modified to include a horizontal tab for connecting the table surfaces.
3. The outer alignment disks 66 are eliminated.
4. The base 22 is exchanged for an alternate base 24 of size and mass sufficient to provide stabilization for one end of each table surface without requiring anchor bolts.
5. The void for the wiring 48 has been eliminated.

Operation

The additional embodiment operations are identical to the preferred embodiment except that the outer alignment disk operation and wiring void option have been eliminated.

Conclusion, Ramifications, and Scope

Accordingly the reader will see that my articulated modular table provides a means by which one person can quickly and conveniently move two or more tables into multiple positions without lifting, pulling, banging, unlatching, and reinserting major components. Furthermore the articulated modular table has additional advantages in that

- it provides a geometric arrangement that maximizes the use of space within a rectilinear room;
- it provides for exact positioning each time it is reconfigured by means of a stationary pivot point;
- it provides a means of moving each table surface independent of the other;
- it provides a support structure that allows a variety of table surfaces to be interchanged;
- it provides a wiring void through the structure in an aesthetically pleasing way to provide support for data, phone, or electrical devices.

While my above description contains many specificities these should not be construed as limitations on the scope of the invention, but as merely providing illustrations of some of the presently preferred embodiments of this invention. For example there are various materials the support components could be made of such as metal, plastic, and composite materials of sufficient strength to support the structure. The pivoting mechanism assembly could include many bearing manifestations such as a simple pin and hinge, a sleeve bearing, and a continuous needle bearing.

The components could be joined by alternate methods such as gluing, friction fitting, mechanical fasteners, welding, brazing, and soldering.

The tabletop could have a variety of novel shapes dependent only on the degree of functionality required.

The table surfaces could be constructed of almost any material or combination of materials suitable for the required utility of the surface. In addition to natural finishes, any of the components could be rendered in any color finish suitable for adhesion to the material substrate.

Accordingly, the scope of the invention should not be determined by the embodiments illustrated but by the appended claims and their legal equivalents.

I claim:

1. An articulating table comprising a stationary support structure for joining and independently pivoting two co-planar surfaces of adjacent tables wherein said tables share a common pivot point located at the inside corners of said tables on one end thereof with inside corner geometry further described as the intersection of bounding axes of adjacent sides of said tables and mounted on the other end of each undersurface of said tables a support leg having a pivoting wheel mounted there-under enabling said tables to rotate on a surface around said structure wherein said tables can be easily configured in a variety of alternative positions including a plurality of contiguous co-planar surface arrangements.

2. The table arrangement of claim 1 wherein said wheel has a brake mechanism including a lever whereby said wheel can be locked and unlocked by said lever.

3. The table arrangement of claim 1 wherein the said wheel has a height adjustment means including a height adjustment screw and an adjustment nut whereby the height of said table surfaces can be modified.

4. The table arrangement of claim 1 wherein said table surfaces have a rectilinear configuration with a complimentary notch at each corner thereof, whereby similar tables can be joined in a modular configuration to provide a variety of alternate positions including continuous surfaces of said tables.

5. The table arrangement of claim 4 wherein a plurality of surfaces defined by said notches have a slot circumscribed in said surfaces so that alignment disk can be inserted into said slots and secured by inserting a plurality of alignment pins through a plurality of aligned holes in said table surfaces and said alignment disks whereby said table surfaces can be coupled.

6. The table arrangement in claim 1 wherein said pivoting support structure includes a wiring raceway wherein said raceway comprises a void at the base, a path through the center of said support and an exit hole at the top of said support whereby wiring can be inserted through said raceway for use on said table surfaces.

* * * * *